US009947299B2

(12) United States Patent
Odinak et al.

(10) Patent No.: US 9,947,299 B2
(45) **Date of Patent: *Apr. 17, 2018**

(54) SYSTEM AND METHOD FOR OFFLINE CONTENT DELIVERY THROUGH AN ACTIVE SCREEN DISPLAY

(71) Applicant: Gilad Odinak, Bellevue, WA (US)

(72) Inventors: Gilad Odinak, Bellevue, WA (US); Maxim Shavit, Petach Tiqwa (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/057,104

(22) Filed: Feb. 29, 2016

(65) Prior Publication Data

US 2016/0275921 A1 Sep. 22, 2016

Related U.S. Application Data

(63) Continuation of application No. 13/377,524, filed on Mar. 12, 2012, now Pat. No. 9,275,166.

(60) Provisional application No. 61/186,347, filed on Jun. 11, 2009.

(51) Int. Cl.
*G09G 5/39* (2006.01)
*G09G 5/00* (2006.01)

(52) U.S. Cl.
CPC ..... *G09G 5/39* (2013.01); *G09G 5/003* (2013.01); *G09G 2330/021* (2013.01); *G09G 2370/04* (2013.01)

(58) Field of Classification Search
CPC ..... G09G 2330/021; G09G 2370/04; G09G 5/003; G09G 5/39
USPC ..... 375/240.27
See application file for complete search history.

(56) References Cited

U.S. PATENT DOCUMENTS 5,579,055 A * 11/1996 Hamilton ..... H04N 1/00098 348/468
6,373,498 B1 * 4/2002 Abgrall ..... G06F 9/4406 345/619
2004/0125959 A1 * 7/2004 Beuque ..... H04L 9/0891 380/279
2005/0031308 A1 * 2/2005 Fu ..... G11B 15/1816 386/329
2006/0139444 A1 * 6/2006 Sau ..... H04Q 3/0045 348/14.07
2006/0190357 A1 * 8/2006 Fuchs ..... G06F 9/4401 705/14.4
2008/0165246 A1 * 7/2008 Jung ..... H04N 7/141 348/14.12
2008/0250150 A1 * 10/2008 Chang ..... H04N 1/00204 709/229
2009/0128447 A1 * 5/2009 Yoshikawa ..... G06F 3/1431 345/1.1

(Continued)

*Primary Examiner* — Francis Geroleo
(74) *Attorney, Agent, or Firm* — Patrick J. S. Inouye; Krista A. Wittman

(57) ABSTRACT

A system and method for offline content delivery through an active screen display is provided. Data for display and content to be displayed at a later time are encoded as a display signal for delivery. An active screen display is associated with a computer and coupled to a processor over a physical display interface connection. The display signal is received and decoded to distinguish the data for display from the content to be displayed at a later time. The content to be displayed at a later time is displayed via the active screen display when the computer is one of turned off and inactive.

20 Claims, 2 Drawing Sheets

(56) References Cited

U.S. PATENT DOCUMENTS

2009/0177952 A1* 7/2009 Yokosato ..... H04N 21/234309
714/799
2010/0293105 A1* 11/2010 Blinn ..... G06Q 10/10
705/319

* cited by examiner

SYSTEM AND METHOD FOR OFFLINE CONTENT DELIVERY THROUGH AN ACTIVE SCREEN DISPLAY

CROSS-REFERENCE TO RELATED APPLICATION

This patent application is a continuation of U.S. Pat. No. 9,275,166, issued Mar. 1, 2016, which is a National Stage Entry of PCT/US2010/38234, filed Jun. 10, 2010, which claims priority under 35 USC § 119(e) to U.S. provisional patent application, Ser. No. 61/186,347, filed Jun. 11, 2009, the priority filing dates of which are claimed and the disclosures of which are incorporated by reference.

FIELD

The present invention relates in general to personal computer displays and, in particular, to a system and method for offline content delivery through an active screen display.

BACKGROUND

Personal computer and their attached monitors or displays, as well as laptop computers, have become common household appliances, with many homes having more than one personal computer system. The displays generally remain idle when the personal computer is not in use. Nevertheless, many personal computers are often located in central places in a home and the displays could potentially be used to independently display content, for example, pictures, calendar, or advertisements, that does not require the active computational resources of the personal computer.

Conventional software applications exist to utilize the display for such purposes. Generally, these applications require the personal computer to be turned on to display the content, even though the personal computer is not being used in a manner that involves active human user interaction via the user interface. While running, though, the personal computer consumes energy, is subject to wear and tear, and remains vulnerable to malicious software.

Personal computer displays are increasingly becoming available with onboard storage, external media readers, and internal logic to unilaterally display content, whether visual, audio, or both. For instance, active digital picture frames are widely available and include a receptacle to accommodate external storage media storing, for instance, digital pictures or music, even when not connected to an active "on" personal computer. However, loading the content from external media requires manual operation by the user and physical custody of the external media, such as a memory card, with the inconvenience of operating and increased costs associated with replicating user interface controls. Moreover, the content to be transferred to the active display oftentimes originates at the personal computer itself, and even though the two devices, the personal computer and the active display, may already be physically connected, a convenient and automated way to transfer the content into the active display's onboard is lacking.

One possible approach is to connect the processing unit of a personal computer to an active display using a special purpose cable or via wireless interconnect to transfer content from the personal computer into the active display's onboard memory. However, matching and compatible computers and active displays are required, in addition to specialized hardware for communication and labor for installation.

Therefore, there exists the need for a mechanism to transfer content from a personal computer or other external source to an active display for later viewing, particularly when the personal computer is turned off or inactive.

SUMMARY

In one embodiment, an existing connection between the processing unit of a personal computer and an active display is utilized with the active display being provided with additional functionality. Specifically, a computer-implemented system and method for offline delivery of content through an active screen display. A processor includes an encoding application to assemble and encode digitally-stored content into encoded content, and to interleave the encoded content with a signal conveying a live screen representation. The live screen representation includes output of a user interface for applications executing on the processor. An active screen display is coupled to the processor over a physical display interface connection. The active screen display includes a runtime application to identify the encoded content within the signal on the active screen display and to decode the encoded content into decoded content. The active screen display further includes an offline application to unilaterally display the decoded content on the active screen display without use of the processor and in an absence of the live screen presentation.

DETAILED DESCRIPTION

Figure 1:
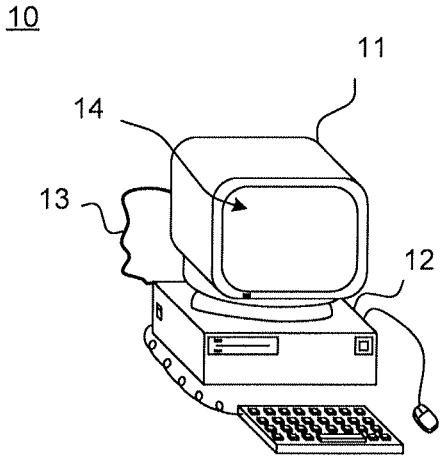
FIG. 1 is a functional block diagram showing a system for sending additional information to a personal computer display in accordance with one embodiment.

Typically, a personal computer connects to a display monitor using an analog data transmission cable, such as an RGB ("red, green, blue") cable, although other data transmission formats exists, such as described in http://computer-.howstuffworks.com/monitor3.htm, the disclosure of which is incorporated by reference. FIG. 1 is a functional block diagram showing a system 10 for sending additional information to a personal computer display 11 in accordance with one embodiment. A connection 13 between the processing unit 12 of the personal computer system 10 carries the information required to render images 14 prepared by the computer hardware to the display 11.

Figure 2:
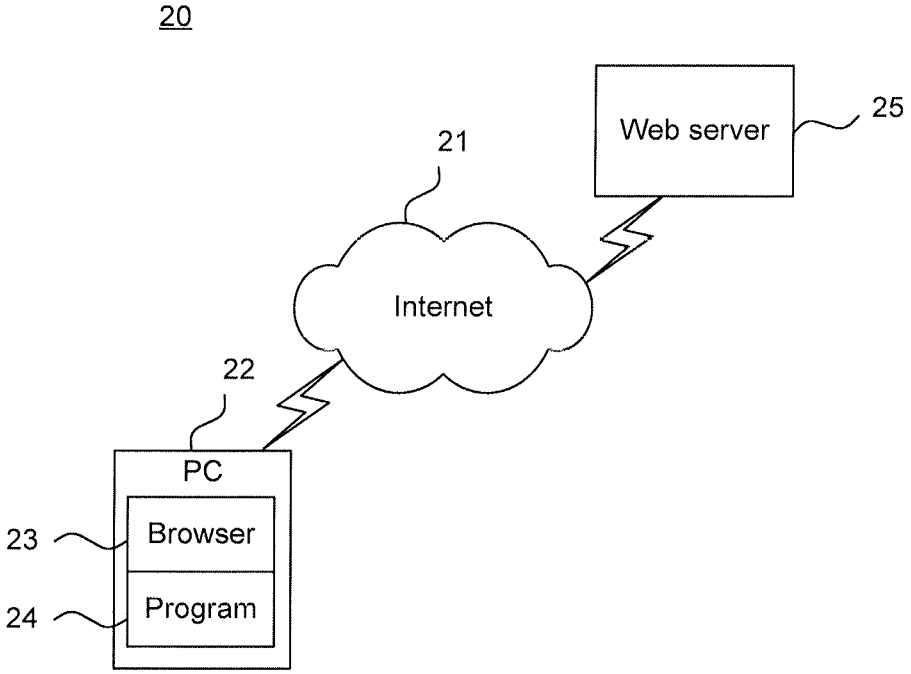
FIG. 2 is a functional block diagram showing, by way of example, an environment within which the system of FIG. 1 operates.

Conventionally, the connection 13 lacks the ability to deliver significant amounts of data during normal operation. An application program, either residing on the personal computer locally, or externally delivered from an external source, such as removable media or over the Internet, encodes content to be displayed at a later time as an image on the display 11. FIG. 2 is a functional block diagram showing, by way of example, an environment 20 within which the system 10 of FIG. 1 operates. The personal computer 22 can be remotely interconnected to a Web server 25, either through wired or wireless connection, via an internetwork, such as the Internet. The personal computer 22 executes the application program 24 and can additional execution a Web browser 23, with which to access Web content. The application program 24 provides logic for simultaneously delivering content from the processing unit of a personal computer to an active display. The content is sent as part of the images 14 being displayed under normal interactive use, but is encoded in a way that enables the active display to recognize the content as content to be displayed at a later, particularly when the personal computer is turned off or inactive.

Figure 3:
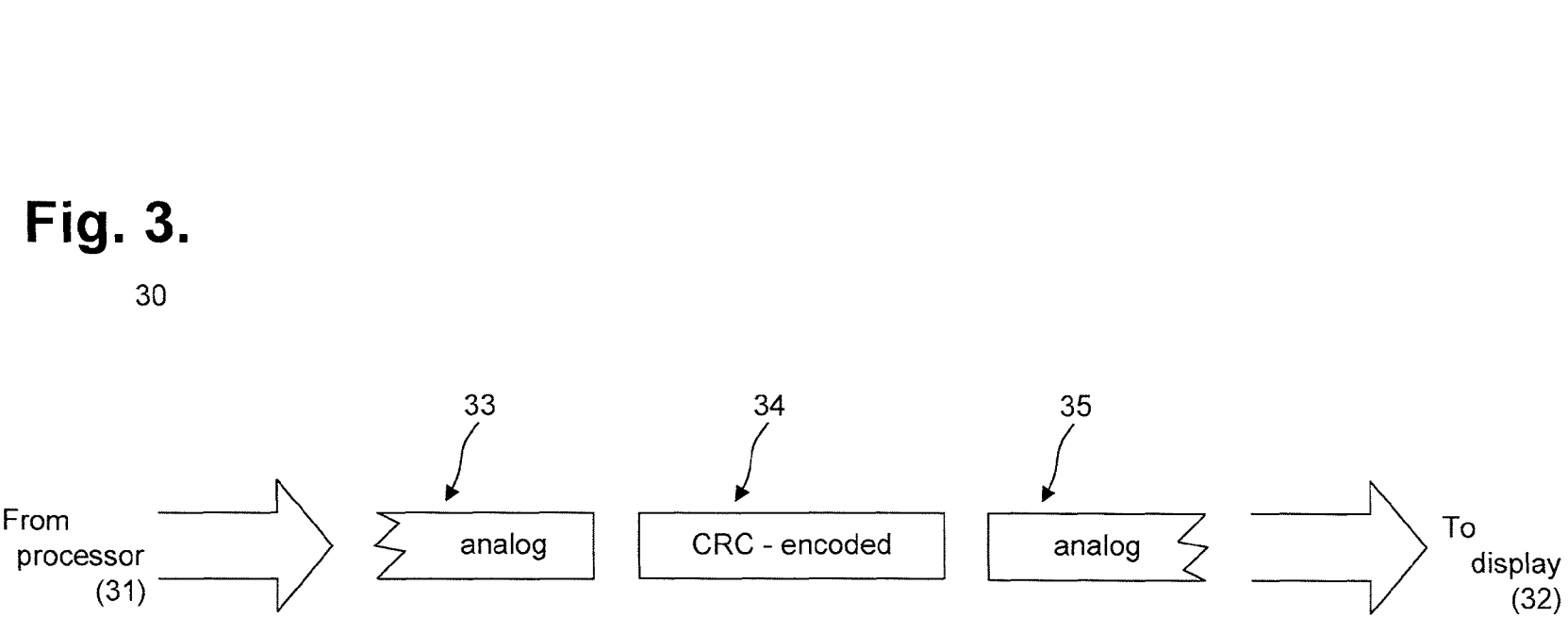
FIG. 3 is a flow diagram showing, by way of example, information encoded within a display signal.

The encoding scheme triggers another application program, which resides in the active display, to decode and positively identify the information as content to be displayed at a later time. FIG. 3 is a flow diagram showing, by way of example, information 30 encoded within a display signal. In a further embodiment, the information may include additional instructions, for example, timing, ordering, placement, and other directions pertaining to display of the content.

A suitable encoding scheme encodes arbitrary data sent from a processor 31 to a display 32 in a way that creates a pattern that follows certain rules. The active display 11 (shown in FIG. 1) checks the incoming stream of data. When the application program on the active display 11 recognizes a section that follows the rules, the data is saved for later use. The encoding scheme is chosen to minimize the chances that arbitrary data sent to the active display 11 will be erroneous decoded and misidentified as content to be displayed at a later time.

One suitable encoding scheme partitions the additional data sent to the active display 11 into fixed length blocks 33-34, and applies a Cyclic Redundancy Check (CRC) to each block, such as described in http://en.wikipedia.org/wiki/Cyclic_redundancy_check, the disclosure of which is incorporated by reference. As the active display 11 receives the data from the personal computer, a CRC is computed on an ongoing basis. Whenever the CRC correctly validates a block 33-34, the active display 11 stores the data in the block for later use.

Another suitable encoding scheme uses a Message Digest, for example MD5, such as described in http://en.wikipedia.org/wiki/Md5, the disclosure of which is incorporated by reference. In a manner similar to that used with a CRC, the application program 24 on the personal computer 22 (both shown in FIG. 2) creates an identifier for each data block 33-34 and sends the identifier together with the data. At the receiving end, the active display 11 independently calculates the MD5 hash code and compares the result to the one identifier with the data. If the identifier and hash code match, the data in the block is stored for later use. Still other suitable encoding schemes are possible.

Attempting to decode each possible sequence of bits in the incoming data stream can be computationally expensive. In a further embodiment, to lower computational expense, the personal computer prepends a preamble (not shown) to mark or delimit the beginning of each block 33-34. The active display 11 scans the incoming data for the preamble and only starts decoding the data for potential additional data when a preamble is encountered. Other markings or delimiters are possible, and can be provided prior to, within, or after the additional data.

The data to be actively displayed is often transmitted from the processing unit 12 of the personal computer 10 to the active display 11 using an analog connection 13. Such connections, though, can be prone to distortions and transmission errors, which can degrade the quality of the image displayed.

Moreover, these errors can potentially corrupt the additional data being transferred. In a still further embodiment, to reduce or overcome such errors, the data blocks can be further supplemented with error correction information, for example, by using the Reed Solomon Code, such as described in http://en.wikipedia.org/wiki/Reed-Solomon-_code, the disclosure of which is incorporated by reference. Other error correction schemes are possible.

The additional data to be delivered to the active display 11 can originate, for instance, on the personal computer itself, from removable media, or via a remote Internet site. A section on the screen can be set aside to signal on-going transfer of the additional data. The section can be, for example, a rectangular window or an icon in the system task bar, preferably with a human readable caption, explaining its purpose. Inside the section, the user will see seemingly meaningless shapes and colors; however, the active display 11 receiving the information will recognize the additional data thus displayed as content to be saved for later use by employing the above described techniques.

In further embodiment, when the active display 11 recognizes an area on the screen as being used to transfer the additional data, an alternate image can be displayed in that area, perhaps using other previously saved data, or the area could be left blank, as to not distract the user with seemingly meaningless image.

In yet another embodiment, the additional data may be interleaved with other meaningful images, such that the additional data would not marginally degrade the quality of the main image being actively displayed. A stronger version of the above-mentioned encodings and error correction mechanisms could then be employed to recover the additional data from the main image.

The transfer of data from, for example, a particular Web site served by a Web server 25 to the active display 11 will usually be initiated by the user of the personal computer 22 while the computer is turned on. At times, the active display 11 may need to prompt the user to access the Web site to facilitate the transfer of the additional data. The active display 11 may resize the image sent by the personal computer to not cover the entire screen. The active display 11 may also generate a message or reminder instructing the user on how to access the Web site. Once the information has been transferred, the active display 11 resumes normal operation.

While the invention has been particularly shown and described as referenced to the embodiments thereof, those skilled in the art will understand that the foregoing and other changes in form and detail may be made therein without departing from the spirit and scope of the invention.

What is claimed is:

1. A system for offline content delivery through an active screen display, comprising:

a processor to interleave a display signal conveying data for a live screen representation to be actively displayed under normal interactive use with encoded content comprising data to be displayed at a later time that is different than display of the data for the live screen representation and to transmit the display signal; and an active screen display associated with a computer and coupled to the processor over a physical display interface connection, comprising:

a runtime application to receive the display signal comprising the encoded content to be displayed at a later time, to decode the encoded content to be displayed at a later time, and to distinguish the data for the live screen representation from the interleaved decoded content to be displayed at a later time that is different than display of the data for the live screen representation based on the encoding; and an offline application to display on the active screen without use of the processor only the decoded content to be displayed at a later time when the computer is one of turned off and inactive and the live screen representation is no longer available.

2. A system according to claim 1, wherein the data for the live screen representation and the encoded content to be displayed at a later time are partitioned into fixed length blocks.

3. A system according to claim 2, wherein the data for the live screen representation is distinguished from the encoded content to be displayed at a later time by applying a cyclic redundancy check to each fixed length block, validating one or more of the fixed length blocks based on the cyclic redundancy check, and storing the validated fixed length blocks for later use.

4. A system according to claim 2, wherein the data for the live screen representation is distinguished from the encoded content to be displayed at a later time by creating an identifier for each fixed length block, transmitting the identifiers with the fixed length blocks, calculating a hash code for each of the fixed length blocks, comparing for each fixed length block the hash code with the identifier, and storing those fixed length blocks for later use when the hash code matches the identifier.

5. A system according to claim 2, wherein the decoding of the encoded content for display at a later time comprises marking a beginning of the fixed length blocks for content for display at a later time with a preamble, scanning the display signal for the preambles, and commencing decoding of those fixed length blocks when the preambles are encountered.

6. A system according to claim 2, wherein each of the fixed length blocks are supplemented with error correction information.

7. A system according to claim 1, wherein instructions are encoded with the encoded content for display at a later time, wherein the instructions comprise one or more of timing, ordering, placement, and display of the content.

8. A system according to claim 1, wherein the active screen display displays an indication of ongoing transfer of the encoded content to be displayed at a later time.

9. A system according to claim 1, wherein the decoded content to be displayed at a later time is displayed as an image.

10. A system according to claim 1, wherein the content to be displayed at a later time originates from one or more of the computer, removable media, and a remote Internet site.

11. A method for offline content delivery through an active screen display, comprising:

encoding via a processor content to be displayed at a later time that is different than display of data for a live screen representation to be actively displayed under normal interactive use, wherein the processor is coupled to an active screen display associated with a computer;

interleaving the encoded content with a display signal conveying the data for the live screen representation;

transmitting the display signal over a physical display interface connection;

receiving via the active screen display the display signal comprising the encoded content to be displayed at a later time;

decoding the encoded content to be displayed at a later time;

distinguishing the data for the live screen representation from the interleaved decoded content to be displayed at a later time that is different than display of the data for the live screen representation based on the encoding; and displaying on the active screen without the use of a processor only the decoded content to be displayed at a later time when the computer is one of turned off and inactive and the live screen representation is no longer available.

12. A method according to claim 11, further comprising:

partitioning the data for the live screen representation and encoded content to be displayed at a later time into fixed length blocks.

13. A method according to claim 12, wherein the data for the live screen representation is distinguished from the encoded content to be displayed at a later time, comprising:

applying a cyclic redundancy check to each fixed length block;

validating one or more of the fixed length blocks based on the cyclic redundancy check; and storing the validated fixed length blocks for later use.

14. A method according to claim 12, wherein the data for the live screen representation is distinguished from the encoded content to be displayed at a later time, comprising:

creating an identifier for each fixed length block;

transmitting the identifiers with the fixed length blocks;

calculating a hash code for each of the fixed length blocks;

for each fixed length block, comparing the hash code with the identifier; and storing each such fixed length block for later use when the hash code matches the identifier.

15. A method according to claim 12, wherein the decoding of the encoded content for display at a later time comprises:

marking a beginning of the fixed length blocks for content for display at a later time with a preamble;

scanning the display signal for the preambles; and commencing decoding of those fixed length blocks when the preambles are encountered.

16. A method according to claim 12, further comprising:

supplementing each of the fixed length blocks with error correction information.

17. A method according to claim 11, further comprising:

encoding instructions with the encoded content for display at a later time, wherein the instructions comprise one or more of timing, ordering, placement, and display of the content.

18. A method according to claim 11, further comprising:

displaying on a portion of the active screen display ongoing transfer of the encoded content to be displayed at a later time.

19. A method according to claim 11, further comprising:

displaying the decoded content to be displayed at a later time as an image.

20. A method according to claim 11, wherein the content to be displayed at a later time originates from one or more of the computer, removable media, and a remote Internet site.

* * * * *